United States Patent [19]

Hwang

[11] Patent Number: 4,989,292

[45] Date of Patent: Feb. 5, 1991

[54] SMALL DUST CATCHER

[76] Inventor: Chin-Lin Hwang, 5Fl., No. 1-3 Lane 178, Chuang Ching Rd., Taipei, Taiwan

[21] Appl. No.: 444,826

[22] Filed: Dec. 1, 1989

[51] Int. Cl.[5] ..... A47L 5/24

[52] U.S. Cl. ..... 15/344; 15/354; 15/414; 15/347; 200/293.001; 200/533

[58] Field of Search ..... 15/300 R, 328, 329, 15/344, 354, 410, 412, 414, 415 R, DIG. 8, 347; 200/558, 573, 293.1, 332, 332.2, 343

[56] References Cited

U.S. PATENT DOCUMENTS

| | | | |
|---|---|---|---|
| 2,701,288 | 2/1955 | Russell et al. | 200/293.1 X |
| 3,715,544 | 2/1973 | Duve | 200/533 |
| 4,209,875 | 7/1980 | Pugh et al. | 15/344 |
| 4,421,964 | 12/1983 | Buchtel | 15/344 X |
| 4,573,237 | 3/1986 | Kocht et al. | 15/344 |
| 4,577,365 | 3/1986 | Yuen | 15/344 X |
| 4,682,384 | 7/1987 | Prohl et al. | 15/344 |

FOREIGN PATENT DOCUMENTS

| | | | |
|---|---|---|---|
| 2101705 | 7/1972 | Fed. Rep. of Germany | 200/332.2 |
| 3020373 | 9/1981 | Fed. Rep. of Germany | 15/344 |
| 3228491 | 2/1984 | Fed. Rep. of Germany | 15/344 |

*Primary Examiner*—Ernest G. Cusick

[57] ABSTRACT

A small dust catcher includes a main tube and an inlet section. The inlet section is releasably connected to the main tube. The dust catcher further includes a filter assembly which is removably supported with an upper opening of the inlet section, with an upright positioning piece being located within a central opening of a partition wall. This uncomplicated arrangement makes it particularly easy to remove the filter assembly for cleaning or maintenance, while ensuring that the filter assembly is held securely in place during use. The dust catcher further includes a fan, a motor and a battery case, and a cover which covers the battery case. The fan, motor and battery case form a one piece assembly which can be disconnected from the main tube. This makes it easy to get at the fan, motor and battery case for maintenance. Preferably, the dust catcher simulates the appearance of a pen. Preferably, an elongated pin simulates the appearance of a pen clip and biases a switch button toward a released or off position.

10 Claims, 3 Drawing Sheets

A-A SECTION

SMALL DUST CATCHER

BACKGROUND OF THE INVENTION

1. Field of the Invention

The present invention relates to a small dust catcher, particularly a small dust catcher with a switch and a filter, and which is easy to operate and maintain.

2. Description of the Related Art

A conventional small dust catcher is illustrated in FIG. 3. The conventional dust catcher includes a suction mouth A, a main tube B, a hood C, a battery case D, a motor E, a fan F, a gauze filter and frame support G and a switch H. The switch H is located outside of the main tube B.

The suction mouth A is inserted into the main tube B and is connected to a lower end of the main tube B by a member I.

The filter and frame support G is fixed in position by pieces J which are located on the inner wall of main tube B.

The battery case D, motor E and fan F are assembled, as one piece, above the support G on a locating stage K. A screw L, which extends outside of the tube B, secures the battery case D, motor E and fan F. Finally, the hood C is placed atop the tube B.

The dust catcher is operated by simply pushing the switch H. This actuates the motor E, which rotates the fan F to create a vacuum which sucks dust into the dust catcher.

The switch H has a movable button which must be moved aside to turn the motor E off. However, since the motor E is very quiet, users often forget to move the button, which may result in exhaustion of the battery M.

Further, to remove the support G (such as for maintenance), the screw L must be unscrewed and the battery case D, motor E and fan F must be removed from the rear end of the tube B. This is really inconvenient.

Other features and objects of the present invention will become apparent from the following detailed description of preferred embodiments of the invention, with reference to the accompanying drawings.

SUMMARY OF THE INVENTION

An object of the present invention is to overcome the disadvantages of the prior art.

Another object of the present invention is to provide a small dust catcher with an improved switch and filter and frame support.

The present invention relates to a small dust catcher which includes: a main tube; an inlet section which is releasably connected to the main tube; a filter assembly which is removably supported within an upper opening of the inlet section, an upright positioning piece of the filter assembly being located within a central opening of a partition wall of the main tube; a one piece assembly which is releasably connected to the main tube, the one piece assembly including a fan, a motor and a battery case; a cover which covers the battery case, the cover being releasably connected to the main tube; and a switch for turning the motor on and off.

Preferably, the dust catcher simulates the appearance of a pen, with the inlet section simulating the appearance of a pen point, an elongated pin simulating the appearance of a pen clip, an upper opening of the inlet section being located within the lower end of the main tube and an upper end of the main tube being located within a lower opening of the cover.

Preferably, the motor operates quietly and the dust catcher includes a switch which includes: a switch element which is biased toward its off position; and a switch actuator which includes: (1) a button which is adapted to move the switch element to an on position when moved to a pressed position, the button being located within a side opening of the cover when in the pressed position; and the elongated pin, which connects the button to the cover and biases the button toward a released position.

DETAILED DESCRIPTION OF THE PREFERRED EMBODIMENTS

Figure 1:
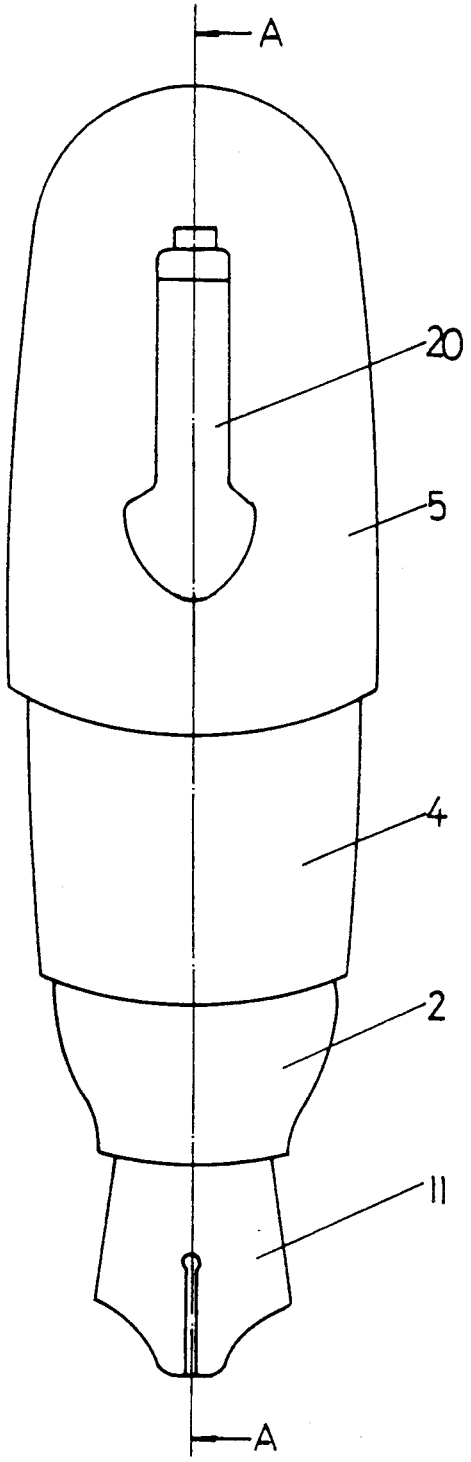
FIG. 1 is a front view of a dust catcher in accordance with the invention.
Figure 2:
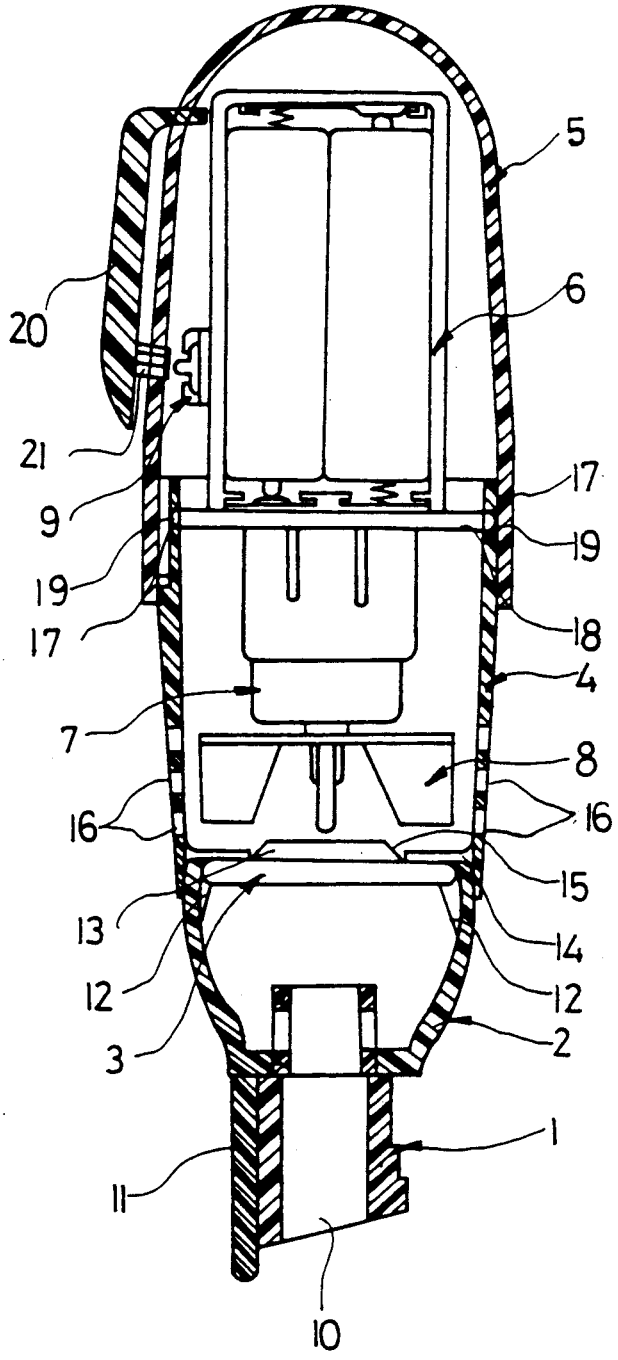
FIG. 2 is a sectional view along the line A—A of FIG. 1.
Figure 3:
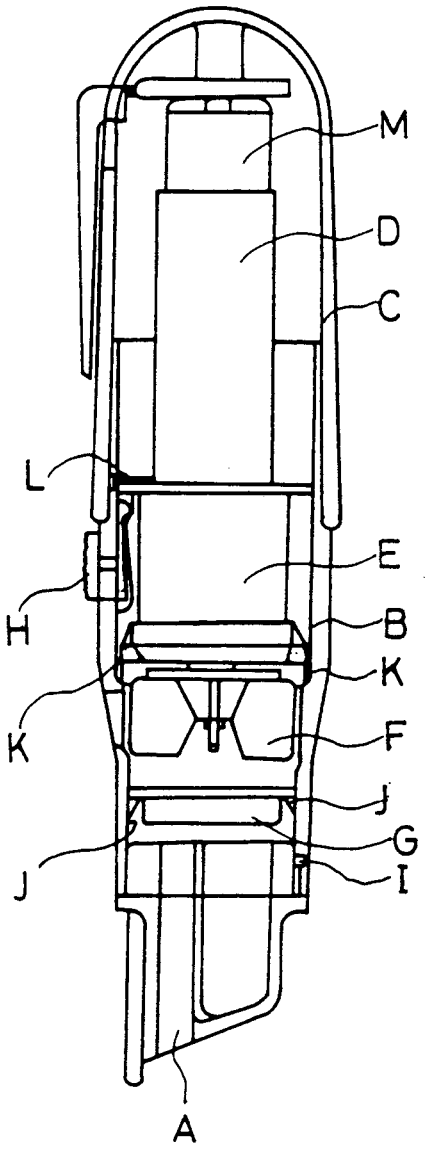
FIG. 3 PRIOR ART
FIG. 3 is a cross sectional side view of a conventional dust catcher.

Referring now to FIGS. 1 and 2, a dust catcher in accordance with the present invention includes a suction mouth 1, a suction mouth bonnet 2, a gauze filter and frame support 3, an elongated, hollow, cylindrical main tube 4, a hood or cover 5, a battery case 6, a motor 7, a fan 8 and a touch switch 9.

The sunction mouth 1 has a tubular, hollow passage 10. A decorative structure 11 which looks like a pen point is located on an outer face of the mouth 1.

The upper end of the mouth 1 is inserted into the lower end of the bonnet 2 and coupled to the bonnet 2. Locating pieces 12 are arranged around an upper side of an inner wall of the bonnet 2. The support 3 is positioned and supported on the locating pieces 12.

The frame of the support 3 is connected to a gauze fillter which has suitable apertures.

The support 3 has a circular shape with an outer diameter which corresponds to the inner diameter of the upper end of the bonnet 2. The support 3 further includes an upright positioning piece 13 on its top side. The piece 13 is inserted into a central opening 15 of a partition board 14. The partition board 14 is arranged near the lower end of the main tube 4.

The clean or maintain the gauze filter and frame support 3, the bonnet 2 is simply pulled out of the lower end of the tube 4. The support 3 can then be easily removed from the upper end of the bonnet 2 and cleaned or maintained.

In operation, air is sucked through the mouth 1 by the fan 8 and is filtered by the gauze filter. The filtered air is driven out of the main tube 4 through air vents 16.

The main tube 4 is provided with a fillister 17 with which to meet a member 19 of a coupling sheet 18. The sheet 18 is the bottom face of the battery case 6. The battery case 6, motor 7 and fan 8 form a one piece assembly. The assembly is fixed in position by the fillister 17, member 19 and sheet 18. The battery case 6, motor 7 and fan 8 are generally the same as those of the conventional dust catcher.

As shown in FIG. 2, the hood 5 (which houses the battery case 6) protrudes from and is coupled to the upper end of the main tube 4. A pin 20 is connected to the outside of the hood 5. For decoration, the pin 20 looks like a pen clip.

The pin 20 includes a touch button 21 for the touch switch 9. The button 21 is located at the lower end of the inner side of the pin 20. The button 21 passes through a cavity to oppose the touch switch 9. The touch switch 9 is arranged at the side of the battery case 6. The button 21 is directly adjacent the switch 9.

In operation, when the pin 20 is pressed or held in a user's hand, the button 21 makes contact with the switch 9 such that power is conducted to the motor 7, causing dust-sucking action. When the pin 20 is released, the motor 7 is automatically disconnected from the power source to avoid any battery power exhaustion. Waste is prevented since the user cannot forget to switch the device off.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A small dust catcher, comprising:

a main tube which includes a lower end, an upper end, a partition wall and an outlet vent, the partition wall being located near the lower end, the partition wall including a central opening;

an inlet section which is releasably connected to the main tube, the inlet section including an inlet opening and an upper opening;

a filter assembly which includes a filter and an upright positioning piece, the filter assembly being removably supported within the upper opening of the inlet section, the upright positioning piece of the filter assembly being located within the central opening of the partition wall;

a one piece assembly which is releasably connected to the main tube, the one piece assembly including:

(a) a fan for drawing air through the inlet opening of the inlet section, through the filter and through the outlet vent of the main tube, the fan being located within the main tube;

(b) a motor for rotating the fan; and (c) a battery case for supplying power to the motor;

a cover which covers the battery case, the cover being releasably connected to the main tube; and a switch for turning the motor on and off.

2. The small dust catcher of claim 1, wherein the upper opening of the inlet section is located within the lower end of the main tube.

3. The small dust catcher of claim 2, wherein the inlet section includes a plurality of locating pieces for supporting the filter assembly, the plurality of locating pieces being horizontally aligned near the partition wall of the main tube.

4. The small dust catcher of claim 3, wherein the filter assembly includes a circular frame, the frame being located between the locating pieces and the partition wall.

5. The small dust catcher of claim 4, wherein the filter is formed of gauze.

6. The small dust catcher of claim 1, wherein the one piece assembly includes a coupling sheet, the coupling sheet being located near the upper end of the main tube, the coupling sheet being connected to the main tube.

7. The small dust catcher of claim 6, wherein the coupling sheet is located between the motor and the battery case, the motor being located within the main tube, the battery case being located within the cover.

8. The small dust catcher of claim 7, wherein the cover includes a lower open end, the upper end of the main tube being located within the lower open end of the cover.

9. The small dust catcher of claim 1 wherein the switch includes:

(a) a switch element which is movable between an on position and an off position, the motor being turned on when the switch element is in the on position, the motor being turned off when the switch element is in the off position, the switch element being biased toward the off position, the switch element being located within the cover; and (b) a switch actuator which includes:

(1) a button which is movable between a pressed position and a released position, the button being adapted to move the switch element to the on position when the button is moved to the pressed position and to permit the switch element to move to the off position when the button is moved to the released position; and (2) an elongated pin for connecting the button to the cover and for biasing the button toward the released position.

10. A small dust catcher which simulates the appearance of a pen, the small dust catcher comprising:

a cylindrical main tube which includes a lower end, an upper end and an outlet vent;

an inlet section which is releasably connected to the main tube, the inlet section including an inlet opening and an upper opening, the upper opening being located within the lower end of the main tube, the inlet section including means for simulating the appearance of a pen point;

a filter which is removably supported within the upper opening of the inlet section;

a one piece assembly which is releasably connected to the main tube, the one piece assembly including:

(a) a fan for drawing air through the inlet opening of the inlet section, through the filter and through the outlet vent of the main tube;

(b) a motor for quietly rotating the fan; and (c) a battery case for supplying power to the motor;

a cover which covers the battery case, the cover being releasably connected to the main tube, the cover including a lower open end and a side opening, the upper end of the main tube being located within the lower open end of the cover; and a switch which includes:

(a) a switch element which is movable between an on position and an off position, the motor being turned on when the switch element is in the on position, the motor being turned off when the switch element is in the off position, the switch element being biased toward the off position, the switch element being located within the cover; and (b) a switch actuator which includes:

(1) a button which is movable between a pressed position and a released position, the button being adapted to move the switch element to the on position when the button is moved to the pressed position and to permit the switch element to move to the off position when the button is moved to the released position, the button being located within the side opening of the cover when the button is in the pressed position; and (2) an elongated pin for connecting the button to the cover and for biasing the button toward the released position, the elongated pin simulating the appearance of a pen clip.

* * * * *